United States Patent [19]

Diehl

[11] 4,367,156

[45] Jan. 4, 1983

[54] BLEACHING PROCESS AND COMPOSITIONS

[75] Inventor: Francis L. Diehl, Cincinnati, Ohio

[73] Assignee: The Procter & Gamble Company, Cincinnati, Ohio

[21] Appl. No.: 291,864

[22] Filed: Aug. 10, 1981

Related U.S. Application Data

[63] Continuation of Ser. No. 165,461, Jul. 2, 1980, Pat. No. 4,283,301.

[51] Int. Cl.[3] ..... C11D 7/54

[52] U.S. Cl. ..... 252/102; 252/95; 252/99; 252/186.39; 252/524; 252/542; 252/DIG. 14; 252/186.38; 252/186.41

[58] Field of Search ..... 252/95, 99, 102, 524, 252/542, 186, DIG. 14, 174.21, 174.22

[56] References Cited

U.S. PATENT DOCUMENTS

| | | | |
|---|---|---|---|
| 2,955,905 | 10/1960 | Davies et al. | 252/95 |
| 3,130,165 | 4/1964 | Brocklehurst | 252/99 |
| 3,359,275 | 12/1967 | Mannheimer | 252/542 |
| 3,583,924 | 6/1971 | Demangeon et al. | 252/102 |
| 3,640,874 | 2/1972 | Gray | 252/95 |
| 3,661,789 | 5/1972 | Corey et al. | 252/186 |
| 3,789,001 | 1/1974 | Painelli | 252/99 |
| 3,816,324 | 6/1974 | Fine et al. | 252/186 |
| 3,822,114 | 7/1974 | Montgomery | 252/95 |
| 3,925,234 | 12/1975 | Hachmann et al. | 252/186 |
| 4,097,305 | 6/1978 | Chiesa, Jr. et al. | 252/542 |
| 4,128,494 | 12/1978 | Sehirmann et al. | 251/186 |
| 4,159,991 | 7/1979 | Dubreux et al. | 260/401 |
| 4,230,590 | 10/1980 | Wixon | 252/524 |
| 4,255,294 | 3/1981 | Rudy et al. | 252/524 |
| 4,283,301 | 8/1981 | Diehl | 252/186 |

FOREIGN PATENT DOCUMENTS 1382594 2/1975 United Kingdom .

OTHER PUBLICATIONS

Effective Bleaching with Sodium Perborate, Gilbert, Detergent Age, Jun. 1967, pp. 18–20, Jul. 1967, pp. 30–33, Aug. 1967, pp. 26, 27 and 67.

*Primary Examiner*—John E. Kittle
*Assistant Examiner*—Hoa Van. Le
*Attorney, Agent, or Firm*—D. E. Hasse; S. J. Goldstein; J. D. Schaeffer

[57] ABSTRACT

Peroxygen fabric bleaching compounds capable of yielding hydrogen peroxide in an aqueous solution are activated by long chain acyl compounds of the formula $$\underset{\underset{O}{\|}}{RCZ} \quad \text{or} \quad \underset{\underset{O}{\|}}{ZCR^1}\underset{\underset{O}{\|}}{CZ},$$

wherein Z is a leaving group which can be certain enols, carbon acids or N-alkyl quaternary imidazoles. The activated bleaching compositions herein are stable and especially suitable for use at relatively low temperatures. Bleaching processes and detergent compositions containing the bleaching compositions are also described.

13 Claims, No Drawings

BLEACHING PROCESS AND COMPOSITIONS

This is a continuation, of application Ser. No. 165,461, filed July 2, 1980, U.S. Pat. No. 4,283,301.

The present invention relates to compositions and processes for bleaching fabrics. The bleaching compositions herein contain certain long chain acyl compounds which activate common peroxygen bleaching compounds to provide stable, yet highly effective, color-safe bleaches especially suitable for use at relatively low temperatures.

The use of bleaching agents as adjuncts to fabric laundering operations is a well established practice, and in many instances a recognized necessity. The most familiar method for bleaching fabrics to remove stains, especially in the context of a home laundering operation, is to add an oxidizing bleach directly to the laundering liquor. Bleaching agents found to be suitable in this regard are well known in the art and include chlorine bleaches, e.g., the alkali metal hypochlorites, and active oxygen-releasing bleaches, e.g., peroxygen bleaching compounds such as hydrogen peroxide, inorganic peroxygen compounds and organic peroxy acids.

The peroxygen bleaches might be expected to be preferred for use over the harsher chlorine bleaches since they are markedly superior as regards fabric handle and absorbency, are safe to fabric colors and are non-yellowing when used to bleach white fabrics. In contrast, the use of stronger bleaches such as the hypochlorites tends to discolor or yellow fabrics over a period of time. Moreover, fabrics bleached with the hypochlorites eventually exhibit significant loss of strength, thus severely curtailing their useful life.

Despite the clear fabric safety advantages inherent in the use of the peroxygen bleaching agents, such agents have a rather serious disadvantage in that their maximum bleaching power can ordinarily be obtained only in bleaching solutions at elevated temperatures (in excess of about 85° C.). This critical temperature dependency poses a serious drawback in view of the extensive use of washing machines that operate at water temperatures ranging from about 15° C. to about 60° C., i.e., well below that necessary to render peroxygen bleaching agents truly effective. Consequently, the peroxygen bleaches do not meet the needs of many users.

BACKGROUND ART

In order to capitalize on the advantageous features of peroxygen bleaches, considerable industrial activity has centered around the search for means to increase their bleaching effectiveness at reduced temperatures, particularly at temperatures of about 60° C. and lower. A variety of compositions have been disclosed in the art which employ a peroxygen bleaching compound in combination with one or more "activator" compounds which are said to promote or otherwise augment the bleaching power of the peroxygen compound, especially at lower temperatures.

U.S. Pat. No. 2,955,905, Davies, et al., issued Oct. 11, 1960, discloses bleaching compositions containing hydrogen peroxide or inorganic persalts and organic carboxylic esters having a titer in the peracid formation of not less than 0.1 N sodium thiosulphate. The esters, which include isopropenyl acetate and Δ'-cyclohexenyl acetate, are said to deliver improved bleaching at temperatures in the range of 50°-60° C.

U.S. Pat. No. 3,816,324, Fine, et al., issued June 11, 1974, describes dry bleaching compositions containing hydrogen peroxide releasing compounds and bleach activators which include various N-acyl azoles. Examples 12 and 13 disclose sodium perborate combined with N-octanoyl imidazole and N-palmitoyl imidazole, respectively. The compositions are said to be useful at relatively low water temperatures.

U.S. Pat. No. 3,640,874, Gray, issued February 8, 1972, describes activated peroxide bleaches containing various N-benzoylimidazole compounds.

Belgian Pat. Nos. 858,048 and 858,049, both published February 24, 1978, describe certain alpha-acyloxy(N,N')-polyacyl malonamide compounds said to be effective activators for peroxygen bleaches at low temperatures.

U.S. Pat. 3,822,114, Montgomery, issued July 2, 1974, relates to the use of aldehydes or ketones to activate certain peroxygen bleaching compounds, but not including those which release hydrogen peroxide in aqueous solution.

U.S. Pat. No. 3,130,165, Brocklehurst, issued April 21, 1964, discloses activated bleaching compositions containing inorganic peroxygen compounds and esters of phenols or substituted phenols with an alpha-chlorinated lower aliphatic carboxylic acid, e.g., chloracetic acid or alpha-chloropropionic acid.

*Effective Bleaching with Sodium Perborate,* Gilbert, Detergent Age, June 1967, p. 18-20, July 1967, p. 30-33, August 1967, p. 26, 27 and 67, describes various activators for sodium perborate and problems inherent in activating oxygen bleaches.

U.S. Pat. No. 3,661,789, Corey, et al., issued May 9, 1972, describes activated peroxygen bleaching systems which are stabilized using nonionic surfactants or glycols.

British Pat. 1,382,594, published February 5, 1975, discloses quaternary ammonium phenyl ester compounds as activators for hydrogen peroxide or per-salt bleaches. The activator is said to have both a per-acid generating structure and a fabric substantive structure. The fabric substantive structure of the activator is said to localize the bleaching species at fabric surfaces and thereby increase bleaching efficiency.

While the above compositions provide varying degrees of peroxygen bleach activation, there is a continuing need for more effective peroxygen activators as cool water bleaching and laundering practices become more common.

It has now been discovered that common peroxygen bleaching compounds can be activated by certain long chain acyl compounds to provide superior bleaching compositions which are stable, safe and highly effective at relatively low temperatures.

SUMMARY OF THE INVENTION

The present invention encompasses a bleaching composition comprising:

(a) from about 1% to about 70% by weight of a peroxygen bleaching compound capable of yielding hydrogen peroxide in an aqueous solution; and (b) from about 1% to about 90% by weight of a bleach activator compound of the formula $$\underset{\underset{O}{\|}}{RCZ} \quad \text{or} \quad \underset{\underset{O}{\|}}{Z}CR^1\underset{\underset{O}{\|}}{C}Z,$$

wherein R is a hydrocarbyl group containing from about 5 to about 13 carbon atoms and additionally containing from 0 to about 10 ethylene oxide groups, provided that when R contains greater than about 9 carbon atoms it must contain at least 2 ethylene oxide groups, $R^1$ is a hydrocarbyl group containing from about 4 to about 24 carbon atoms and additionally containing from 0 to about 10 ethylene oxide groups, provided that when $R^1$ contains greater than about 12 carbon atoms it must contain at least 2 ethylene oxide groups, and each Z is a leaving group, having a pKa of from about 5 to about 20 and a molecular weight of less than about 175, selected from the group consisting of:

(1) enols of the formula

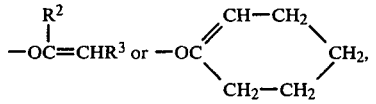

(2) carbon acids of the formula

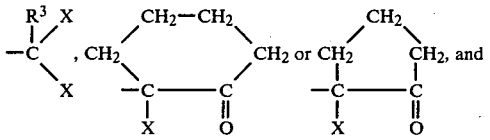

(3) imidazoles of the formula

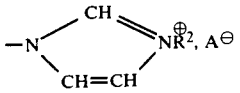

wherein each $R^2$ is alkyl, each $R^3$ is hydrogen or alkyl, A is an anion selected from the group consisting of hydroxide, halide, sulfate, methylsulfate and phosphate, and each X is

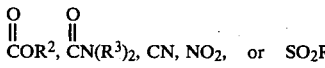

The bleaching compositions disclosed herein are combined with surfactants, buffers, builders, and the like, to provide bleaching and detergent compositions capable of concurrently delivering fabric bleaching and laundering benefits.

A bleaching process in accordance with this invention comprises contacting fabrics with an aqueous solution of the bleaching compositions herein at a solution pH of from about 7 to about 12.

DETAILED DESCRIPTION OF THE INVENTION

The present invention relates to bleaching compositions comprising, as essential components, certain peroxygen bleaching compounds and bleach activator compounds. The activator compound enhances the fabric bleaching properties of the peroxygen compound, especially when used at relatively low solution temperatures, thus providing improved bleaching compositions.

The Peroxygen Bleaching Compound

The peroxygen bleaching compounds useful herein are those capable of yielding hydrogen peroxide in an aqueous solution. These compounds are well known in the art and include hydrogen and the alkali metal peroxides, organic peroxide bleaching compounds such as urea peroxide, and inorganic persalt bleaching compounds, such as the alkali metal perborates, percarbonates, perphosphates, and the like. Mixtures of two or more such bleaching compounds can also be used, if desired.

Preferred peroxygen bleaching compounds, herein include sodium perborate, commercially available in the form of mono- and tetra- hydrates, sodium carbonate peroxyhydrate, sodium pyrophosphate peroxyhydrate, urea peroxyhydrate, and sodium peroxide. Particularly preferred are sodium perborate monohydrate and sodium perborate tetrahydrate.

The Bleach Activator Compound

The bleach activator compounds of the present invention have the formula

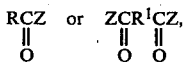

wherein R is a hydrocarbyl group containing from about 5 to about 13 carbon atoms and additionally containing from 0 to about 10 ethylene oxide groups, provided that when R contains greater than about 9 carbon atoms it must contain at least 2 ethylene oxide groups, $R^1$ is a hydrocarbyl group containing from about 4 to about 24 carbon atoms and additionally containing from 0 to about 10 ethylene oxide groups, provided that when $R^1$ contains greater than about 12 carbon atoms it must contain at least 2 ethylene oxide groups, and each Z is a leaving group, having a pKa of from about 5 to about 20 and a molecular weight of less than about 175, selected from the group consisting of:

(1) enols of the formula

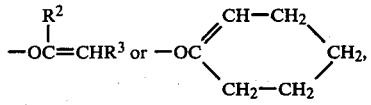

(2) carbon acids of the formula

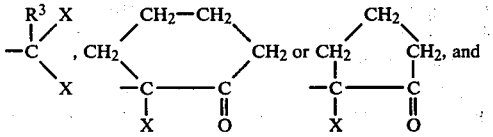

(3) imidazoles of the formula

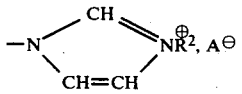

wherein each $R^2$ is alkyl, each $R^3$ is hydrogen or alkyl, A is an anion selected from the group consisting of hydroxide, halide, sulfate, methylsulfate and phosphate, and each X is $$\overset{O}{\overset{\|}{C}}OR^2,\ \overset{O}{\overset{\|}{C}}N(R^3)_2,\ CN,\ NO_2,\ \text{or}\ SO_2R^2.$$

Representative enol leaving groups (Z), as defined above, include:

$-O(CH_3)C{=}CH_2$, $-O(C_2H_5)C{=}CH_2$, $-O(C_4H_9)C{=}CH_2$, $-O(C_6H_{13})C{=}CH_2$, $-O(C_9H_{19})C{=}CH_2$, $-O(CH_3)C{=}CHCH_3$, $-O(CH_3)C{=}CHC_8H_{17}$, $-O(C_2H_5)C{=}CHC_2H_5$, $-O(C_2H_5)C{=}CHC_4H_9$, and other enols of similar structure having a molecular weight less than about 175.

Representative carbon acid leaving groups include: $-CH(CO_2CH_3)_2$, $-CH(CO_2C_2H_5)_2$, $-C(CH_3)(CO_2C_2H_5)_2$, $-CH(CO_2C_2H_5)(CO_2C_3H_7)$, $-CH(CONH_2)_2$, $-CH(CO_2C_2H_5)(CONH_2)$, $-CH(CN)_2$, $-CH(CN)(CO_2C_3H_7)$, $-C(C_4H_9)(CO_2C_2H_5)(CN)$, $-CH(SO_2CH_3)_2$, and $-C(CH_3)_2NO_2$.

The leaving group may also be a 5 or 6 member cyclic carbon acid as defined in the general formula for the activator compounds herein, in which X is, for example, $CO_2CH_3$, $CO_2C_2H_5$, $CONH_2$, $CONHCH_3$, CN, $NO_2$, or $SO_2CH_3$.

Suitable leaving groups also include N-alkyl quaternary imidazoles in which the alkyl is methyl, ethyl, propyl or butyl.

Preferred activator compounds are those in which R and $R^1$, as defined herein, are each hydrocarbyl groups containing about 11 or fewer carbon atoms and additionally containing from 0 to about 5 ethylene oxide groups. The ethylene oxide enhances the solubility of the longer-chain activator compounds, and thus its presence becomes less critical as the length of the hydrocarbyl group R or $R^1$ decreases within the claimed limits. It is especially preferred that R and $R^1$ each be hydrocarbyl groups containing about 9 or fewer carbon atoms.

Activator compounds having the formula $$R\overset{O}{\overset{\|}{C}}Z,$$

as defined herein are also preferred, primarily because of their ease of synthesis but also because they are believed to have a more rapid rate of perhydrolysis, the significance of which is explained later. Preferred activators also include those in which the leaving group Z is selected from the enols and carbon acids defined herein, especially when each X is an ester, amide or cyano group.

The most preferred bleach activator compound herein is isopropenyl hexanoate, which has the formula $$C_5H_{11}\overset{O}{\overset{\|}{C}}-O-\overset{CH_2}{\overset{\|}{C}}-CH_3.$$

Other preferred enol ester activators include isopropenyl heptanoate, isopropenyl octanoate, isopropenyl nonanoate and isopropenyl decanoate.

Another preferred activator compound herein is hexanoyl malonic acid, diethyl ester which has the formula $$C_5H_{11}\overset{O}{\overset{\|}{C}}-CH(\overset{O}{\overset{\|}{C}}OC_2H_5)_2.$$

Also preferred are hexanoyl malonic acid, dimethyl ester; heptanoyl malonic acid, diethyl ester; heptanoyl malonic acid, dimethyl ester; octanoyl malonic acid, diethyl ester; octanoyl malonic acid, dimethyl ester; nonanoyl malonic acid, diethyl ester; nonanoyl malonic acid, dimethyl ester; decanoyl malonic acid, diethyl ester; and decanoyl malonic acid, dimethyl ester.

Preferred activators of the formula $ZCOR^1COZ$ herein include diisopropenyl hexanedioate, diisopropenyl heptanedioate, diisopropenyl octanedioate, diisopropenyl nonanedioate, diisopropenyl decanedioate, and diisopropenyl undecanedioate.

The activator compounds herein can be prepared by methods known in the art starting from commercially available materials. For example, the preparation of enol esters of carboxylic and dicarboxylic acids is described in U.S. Pat. No. 3,878,230, Rothman, et al.; U.S. Pat. No. 3,898,252, Serota, et al.; Rothman, et al.; ENOL ESTERS XIII: *SYNTHESIS OF ISOPROPENYL ESTERS BY ADDITION OF CARBOXYLIC ACIDS TO PROPYNE,* Journal of the American Oil Chemists' Society, 48: 373–375 (1971); and Rothman, et al., ENOL ESTERS III: *PREPARATION OF DIISOPROPENYL ESTERS OF DICARBOXYLIC ACIDS,* Journal of Organic Chemistry, 31, 629 (1966), all incorporated herein by reference.

Although the scope of the present invention is not limited by any particular theory, it is believed that the bleach activation occurs as follows. The peroxygen bleaching compounds herein form hydrogen peroxide in the bleaching or laundering solution. The bleach activator compounds then quickly react with the hydrogen peroxide in this basic solution to form peroxy acids of the formula $$R\overset{O}{\overset{\|}{C}}OOH\ \text{or}\ HOO\overset{O}{\overset{\|}{C}}R^1\overset{O}{\overset{\|}{C}}OOH$$

through a process which is best described as perhydrolysis of the activator compound. It is believed that the peroxy acid, presumably in the form of a highly reactive oxygen-yielding radical, is the species which delivers enhanced bleaching activity relative to the unactivated peroxygen bleach. The rate at which the peroxy acid and the resulting oxygen-yielding reactive radical are formed (i.e., the rate of perhydrolysis) determines the degree of bleach activation, and this has been found to be highly dependent on the identity of the bleach activator compound. Activator compounds of the structure herein and whose leaving groups have a molecular weight of less than about 175 and a pKa of from about 5 to about 20 have a sufficiently rapid rate of perhydrolysis to deliver the desired degree of peroxygen bleach activation.

A notable advantage of the instant bleaching compositions over other art-disclosed activated peroxygen bleaches appears to be due to the relatively long chain hydrocarbyl-lipophilic substituent R or $R^1$ of the activator compounds herein. This substituent is believed to enhance the fabric substantivity of the present activator compounds so that the peroxy acid active bleaching species is generated directly at the surfaces of the fabrics, or if generated in the bulk solution, the bleaching species have sufficient surface activity to concentrate at the fabric surfaces. Thus, the active bleaching species is properly positioned at the fabric surface where it is most effectively utilized, with the result being that improved bleaching of all types of fabrics, and especially dingy fabrics, is secured. The activated bleaching compositions herein are particularly effective when used under cool or warm water (i.e., 10° C. to 60° C.) bleaching conditions, where peroxygen bleaches by themselves are relatively ineffective. In addition, since the peroxy acid bleaching species is formed in situ in the bleaching or laundry solution, free peroxy acids, which are very reactive and prone to deflagration upon contact with moisture during storage, are avoided. Thus, the bleaching compositions herein are considerably safer and more storage-stable than compositions containing such free peroxy acids.

Bleaching compositions herein contain from about 1% to about 70%, preferably from about 5 to about 50%, by weight of the peroxygen bleaching compound and from about 1% to about 90%, preferably from about 5% to about 60%, by weight of the bleach activator compound. More preferably, the bleaching compositions contain the peroxygen compound and the bleach activator compound in approximately equimolar ratios. The peroxygen compounds are, of course, dissolved in aqueous bleaching or laundering solutions in the practice of the present invention. While the in-use concentration of the peroxygen compound can vary widely, depending on the needs of the user, it generally should be present at a level sufficient to provide from about 2 ppm to about 500 ppm, and preferably from about 5 ppm to about 100 ppm, of available oxygen in solution.

Optional Components

The peroxygen compound/bleach activator mixtures of the present invention can, of course, be employed by themselves as bleaching agents. However, such compositions will more commonly be used as one element of a total bleaching or laundering composition. For example, if compositions designed solely as bleaching products are desired, optional, although highly preferred, additional materials would include solubilizing surfactants, buffering agents, builders, and minor components, such as coloring agents, dyes and perfumes.

A highly preferred optional component in the bleaching compositions of the present invention is a detergent surfactant capable of dispersing and solubilizing the long chain bleach activator compound so that maximum contact between the activator and the hydrogen peroxide in the bleaching solution is obtained. The desired peroxy acid species is thereby generated as rapidly as possible in the solution. (The presence of such a solubilizing surfactant is especially important when the activator compound is relatively insoluble due to the length of its hydrocarbyl group R or $R^1$.) The surfactant is preferably premixed with the activator compound, which normally would be available in a liquid state, to form a homogeneous liquid phase. The surfactant/activator mixture is then mixed with the peroxygen bleaching compound and any optional components, such as buffering agents, builders and the like, in the bleaching solution so that the peroxy acid species is generated in the solution.

Detergent surfactants suitable for the above purposes include the conventional nonionic, ampholytic and zwitterionic surfactants described in U.S. Pat. No. 4,006,092, Jones, from column 12, line 52 to column 19, line 11, incorporated herein by reference. The above surfactants should represent from about 1% to about 60%, preferably from about 5% to about 40%, by weight of the concentrated bleaching composition. More preferably, the surfactant should be present in the bleaching composition at about the same amount by weight as the activator compound. It should be noted that conventional anionic surfactants tend to interact with the bleach activator compounds herein and thus are not suitable for the uses described above. Conventional cationic surfactants may be used in minor amounts in combination with the above nonionic, ampholytic or zwitterionic surfactants. Suitable cationic surfactants and preferred nonionic/cationic surfactant mixtures are described in U.S. Pat. No. 4,295,217, Murphy, issued Mar. 31, 1981, and in U.S. Pat. No. 4,222,905, Cockrell, issued Sept. 16, 1980, both incorporated herein by reference.

Preferred surfactants for use herein are the nonionic surfactants described above, especially the polyethylene oxide condensates of alkyl phenols, the condensation products of aliphatic alcohols with ethylene oxide, and the amine oxide and sulfoxide surfactants, or mixtures thereof. Especially preferred are the ethylene oxide condensates of alkyl phenols or aliphatic alcohols which are capped at the terminal hydroxyl group to prevent possible ester interchange reactions with the activator compounds. Suitable capping groups include short chain ($C_1$–$C_4$) alkyl ethers, acetate, cyano, benzyl ether, and the like. Benzyl ether capped alkylphenylethoxylates, commercially available under the tradename Triton from the Rohm and Haas Company, have been found to be especially useful herein.

Since the bleaching process of the instant invention should be carried out in an aqueous solution having a pH of from about 7 to about 12 (outside this pH range, bleaching performance falls off markedly), and preferably at a pH of from about 8.5 to about 10.5, buffering agents can be preferred optional components in the bleaching compositions herein. A buffering agent is any non-interfering compound which can alter and/or maintain the pH of the bleaching or laundering solution. The presence of a buffering agent is especially important when the peroxygen bleaching compound is hydrogen or an alkali metal peroxide or urea peroxide, which may not by themselves provide the desired pH level in solution. Standard buffering agents are phosphates (including orthophosphates and the water-soluble condensed phosphates, such as tripolyphosphates and pyrophosphates), carbonates, bicarbonates, and silicates which buffer within the 7–12 pH range. Examples of suitable buffering agents include sodium bicarbonate, sodium carbonate, disodium hydrogen phosphate and sodium dihydrogen phosphate. Sodium tetrapyrophosphate is a preferred buffering agent/builder for use in the present bleaching compositions. Other buffering compositions for any desired pH can be obtained by the skilled artisan from any standard chemistry handbook or textbook. Buffering agents generally comprise from about 1% to about 85%, preferably from about 5% to about 50%, by weight of the instant concentrated bleaching compositions.

Concentrated bleaching compositions herein also preferably contain from about 1% to about 85%, more preferably from about 5% to about 50%, by weight of one or more conventional detergent builder compounds. Builders useful herein include any of those commonly taught for use in detergent compositions, such as any of the conventional inorganic and organic water-soluble builder salts, the seeded builders and the complex aluminosilicate builders all described in U.S. Pat. No. 4,001,131, Montgomery, from column 9, line 35 through column 11, incorporated herein by reference. The polyacetal carboxylate builders described in U.S. Pat. Nos. 4,144,226 and 4,146,495, both to Crutchfield, et al., incorporated herein by reference, are also useful. Of course, many of the above builders also conveniently function as suitable buffering agents.

In addition to the above-described surfactant, buffer, and builder components, the bleaching compositions of the instant invention can optionally contain any noninterfering ingredients which serve to improve the bleaching and laundering characteristics of the solutions in which they are dissolved or which add aesthetic appeal to the compositions themselves. Such minor ingredients can include enzymes, brighteners, perfumes, coloring agents, anti-redeposition agents, corrosion inhibitors, suds control agents and filler materials. Generally such minor components comprise no more than about 20% by weight of the instant bleaching compositions.

In actual use, the above-described bleaching compositions will generally be either added to a laundering solution which contains conventional detergent formulations or utilized as one portion of laundering compositions containing conventional detergent components. Thus, the invention herein also encompasses detergent compositions comprising the activated bleaching compositions herein and conventional detergent adjunct components, such as surfactants, builders and minor components.

Such detergent compositions will comprise from about 1% to about 50%, preferably from about 5% to about 30%, by weight of the activated bleaching compositions herein, from about 1% to about 50%, preferably from about 10% to about 30%, by weight of a detergent surfactant, and can optionally contain from about 1% to about 60%, preferably from about 10% to about 50%, by weight of a detergency builder material (which can also conveniently serve as the buffering agent). Suitable detergent surfactants and builders in such detergent compositions include any of those described above for use in the bleaching compositions. In addition, conventional anionic surfactants may also be included in such detergent compositions.

Detergent compositions herein may also contain any of the minor components described above as suitable for use in the bleaching compositions. Such minor components represent less than 20%, preferably less than 10%, by weight of the detergent compositions herein.

Preferred detergent compositions because of their effectiveness under cool or cold water laundering and bleaching conditions would include those components described in the pending U.S. patent applications Ser. No. 117,904, Ferry, filed Feb. 4, 1980 Pat. No. 4,266,122, Ser. No. 83,907, Leikhim, et al., and Ser. No. 83,908, Kuzel, et al., both filed Oct. 11, 1979 U.S. Pat. Nos. 4,284,532 and 4,247,424, all incorporated herein by reference.

As described above, the preferred method of preparing the bleaching compositions herein involves premixing the activator compound with a solutilizing surfactant to form a homogeneous liquid phase. This surfactant/activator mixture is then mixed with the peroxygen compound in the bleaching or laundering solution so that the peroxy acid bleaching species is generated in situ in the solution. The peroxygen compound could be one component of a separate bleaching or detergent composition to which the surfactant/activator mixture is added in the washing machine. Alternatively, the peroxygen compound (along with optional builders, buffers and minor components) could be enclosed in one packet or pouch of a convenient two pouch package, the other pouch of which contains the surfactant/activator mixture. The package could be water-soluble or both pouches could be emptied into the washing machine to provide the desired mixing in solution.

In addition, the peroxygen compound and the activator can be dry mixed, along with any optional components, and added to the bleaching or laundering solution as a complete bleaching or detergent composition. However, moisture or free water in such a dry mixed composition should be minimized to prevent the formation of the unstable peroxy acid species outside of the bleaching or laundering solution. If dry blending of the peroxygen and activator compounds is desired, it is preferred that the activator be relatively soluble (i.e., R or $R^1$ should be shorter hydrocarbyl groups within the claimed limits or should contain ethylene oxide groups) and that a solubilizing surfactant be present in the bleaching or laundering solution.

The process for bleaching textile materials in the manner of this invention comprises contacting said textile materials with an aqueous solution of the activated bleach compositions disclosed herein and allowing the materials to remain in the bath for a normal bleaching time of from about 5 to about 30 minutes. The bleaching process herein is carried out at a solution pH of from about 7 to about 12, preferably from about 8.5 to about 10.5, and preferably at a solution temperature of from about 10° C. to about 60° C.

The following non-limiting examples illustrate the bleaching compositions and processes of the present invention.

All percentages, parts, and ratios used herein are by weight unless otherwise specified.

EXAMPLE I

A bleaching composition of the instant invention was formulated as follows:

| Component | Concentration Percent by Weight |
|---|---|
| Sodium perborate tetrahydrate | 25% |
| Sodium tetrapyrophosphate | 12% |
| Isopropenyl hexanoate | 26% |
| *Triton CF-87 | 37% |
| | 100% |

*Benzyl ether capped alkyl phenol ethoxylate, commercially available from the Rohm and Haas Company.

The isopropenyl hexanoate was premixed with the Triton CF-87 to form a homogeneous liquid phase. The mixture was added to a solution having a pH of about 8.9 containing the sodium perborate and sodium tetrapyrophosphate, in an amount such that the above bleaching composition represented about 0.04% by weight of the bleaching solution. The composition effectively bleached a mixed bundle of dingy soiled fabrics without any yellowing or fabric damage at a solution temperature of 40° C.

Substantially similar bleaching results are obtained when the sodium perborate tetrahydrate is replaced by an equivalent amount of sodium perborate monohydrate, sodium carbonate peroxyhydrate, sodium pyrophosphate peroxyhydrate, urea peroxyhydrate, or sodium peroxide, or mixtures thereof.

Comparable results are also obtained when the isopropenyl hexanoate in any of the above compositions is replaced by bleach activator compounds having the following formulas:

$RCO_2(CH_3)C{=}CH_2$, $RCO_2(C_4H_9)C{=}CH_2$, $RCO_2(C_9H_{19})C{=}CH_2$, $RCO_2(C_2H_5)C{=}CHC_2H_5$, $RCOCH(CO_2CH_3)_2$, $RCOCH(CO_2C_2H_5)_2$, $RCOCH(CO_2C_2H_5)(CO_2C_3H_7)$, $RCOCH(CONH)_2$, $RCOCH(CO_2C_2H_5)(CONH_2)$, or $RCOCH(CN)_2$, wherein R is an $C_5$, $C_6$ or $C_9$ alkyl group, or a $C_8$, $C_{10}$, or $C_{12}$ alkyl group containing 2, 4 or 8 ethylene oxide groups.

Similar bleaching results are also obtained when the bleach activator compound in any of the above compositions is replaced by an activator of the formula $ZCOR^1COZ$, wherein each Z is any of the above exemplified leaving groups and $R^1$ is a $C_4$, $C_5$, $C_8$ or $C_{12}$ alkylene group, or a $C_{12}$, $C_{16}$ or $C_{24}$ alkylene group containing 2, 6 or 10 ethylene oxide groups.

EXAMPLE II

A dry bleach composition is prepared by dry blending the following components into a granular form.

| Component | Concentration Percent by Weight |
|---|---|
| Sodium perborate monohydrate | |
| Hexanoyl malonic acid, dimethyl ester | 42% |
| Sodium tripolyphosphate | 20% |

100 grams of the composition are used in 40 liters of wash liquor at a temperature of 60° C. to bleach a 4 Kg load of mixed cotton, polyester and polyester-cotton blend fabrics. Excellent bleaching is secured.

EXAMPLE III

A bleaching composition is as follows:

| Component | Concentration Percent by Weight |
|---|---|
| Sodium carbonate peroxyhydrate | 20% |
| Nonanoic Acid, Δ', -cyclohexenyl ester | 35% |
| Neodol 23-3 | 45% |

*Condensation product of a $C_{12}$–$C_{13}$ linear primary alcohol with 3 moles (avg.) of ethylene oxide, commercially available from Shell Chemical Company.

The foregoing composition is prepared and used in the manner of Example I. Excellent bleaching results are also secured.

EXAMPLE IV

The bleaching compositions of Examples I, II and III are added to a laundering solution containing the following granular detergent composition. The bleaching composition represents about 0.03% by weight, and the detergent composition represents about 0.15% by weight, of the solution. Excellent bleaching and laundering of a mixed bundle of dingy fabrics is obtained at a water temperature of about 15° C.

| Component | Concentration Percent by Weight |
|---|---|
| Coconut alkyl dimethyl amine oxide | 5.0 |
| $C_{12}$–$C_{13}/E_5$ nonionic surfactant* | 10.0 |
| Sodium tripolyphosphate | 18.0 |
| Sodium nitrilotriacetate | 14.0 |
| Sodium carbonate | 20.0 |
| Sodium sulfate | 9.3 |
| Sodium silicate (1.6η) | 6.0 |
| Bentolite L clay** | 3.5 |
| Polyethylene glycol 6000 | 0.9 |
| Water and miscellaneous | Balance to 100 |

*Condensation product of a $C_{12-13}$ linear primary alcohol with 5 moles (avg.) of ethylene oxide.
**A calcium bentonite clay manufactured by Georgia Kaolin Company.

EXAMPLE V

The bleaching compositions of Examples I, II and III are added to a laundering solution containing the following liquid detergent composition. The bleaching composition represents about 0.03% by weight, and the detergent composition represents about 0.15% by weight, of the solution. Excellent bleaching and laundering of a mixed bundle of dingy fabrics is obtained at a water temperature of about 40° C.

| Component | Concentration Percent by Weight |
|---|---|
| Ditallow dimethylammonium chloride | 4.8 |
| $C_{12}$–$C_{13}/E_{6.5}$ nonionic surfactant* | 12.0 |
| $C_{14}$–$C_{15}/E_7$ nonionic surfactant** | 12.0 |
| Ethanol | 14.8 |
| Sodium citrate | 0.66 |
| Water and miscellaneous | Balance to 100 |

*Condensation product of a $C_{12-13}$ linear primary alcohol with 6.5 moles (avg.) of ethylene oxide.
**Condensation product of a $C_{14-15}$ linear primary alcohol with 7 moles (avg.) of ethylene oxide.

EXAMPLE VI

The bleaching composition of Example II is dry mixed with the granular detergent composition described in Example IV, at a weight ratio of bleaching composition to detergent composition of about 1:4, to form a composition capable of concurrently providing fabric laundering and bleaching benefits in water at a temperature ranging anywhere from about 10° C. to about 60° C.

What is claimed is:

1. A bleaching composition consisting essentially of:
   (a) from about 1% to about 70% by weight of a peroxygen bleaching compound selected from the group consisting of hydrogen peroxide, urea peroxide, and alkali metal peroxides, perborates, percarbonates, and perphosphates, and mixtures thereof; and
   (b) from about 1% to about 90% by weight of a bleach activator compound of the formula $$\underset{\underset{O}{\|}}{RCZ} \quad \text{or} \quad \underset{\underset{O}{\|}}{Z}CR^1\underset{\underset{O}{\|}}{C}Z,$$

wherein R is a hydrocarbyl group containing from about 5 to about 13 carbon atoms and additionally containing from 0 to about 10 ethylene oxide groups, provided that when R contains greater than about 9 carbon atoms it must contain at least 2 ethylene oxide groups, $R^1$ is a hydrocarbyl group containing from about 4 to about 24 carbon atoms and additionally containing from 0 to about 10 ethylene oxide groups, provided that when $R^1$ contains greater than about 12 carbon atoms it must contain at least 2 ethylene oxide groups, and each Z is a leaving group, having a pKa of from about 5 to about 20 and a molecular weight of less than about 175, selected from the group consisting of:

imidazoles of the formula

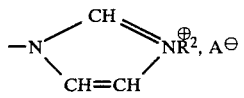

wherein $R^2$ is a $C_1$–$C_4$ alkyl group and A is an anion selected from the group consisting of hydroxide, halide, sulfate, methylsulfate and phosphate.

2. A composition according to claim 1 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide, and mixtures thereof.

3. A composition according to claim 2 wherein the peroxygen bleaching compound is sodium perborate monohydrate, sodium perborate tetrahydrate, or mixtures thereof.

4. A composition according to claim 1 wherein, in the bleach activator compound, R and $R^1$ each contain about 11 or fewer carbon atoms and additionally contain from 0 to about 5 ethylene oxide groups.

5. A composition according to claim 4 wherein R and $R^1$ are each hydrocarbyl groups containing about 9 or fewer carbon atoms.

6. A composition according to claim 1 wherein the bleach activator compound has the formula $$\underset{\underset{O}{\|}}{RCZ}.$$

7. A composition according to claim 1 further containing from about 1% to about 60% by weight of a nonionic, ampholytic, or zwitterionic surfactant, or mixtures thereof, or mixtures thereof with cationic surfactants.

8. A composition according to claim 7 wherein the surfactant is a nonionic surfactant.

9. A composition according to claim 8 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide, and mixtures thereof and the bleach activator compound has the formula $$\underset{\underset{O}{\|}}{RCZ}.$$

10. A composition according to claims 1, 7 or 9 further containing from about 1% to about 85% by weight of a buffering agent selected from the group consisting of alkali metal phosphates, carbonates, bicarbonates, silicates, and mixtures thereof.

11. A process for bleaching textile materials consisting essentially of contacting said textile materials with an aqueous solution of the composition of claims 1, 7 or 9 at a solution pH of from about 7 to about 12.

12. A detergent composition consisting essentially of from about 1% to about 50% by weight of an anionic, cationic, nonionic, ampholytic or zwitterionic surfactant, or mixtures thereof, from about 1% to about 60% by weight of a detergent builder material, and from about 1% to about 50% by weight of a bleaching composition consisting essentially of:

(a) from about 1% to about 70% by weight of a peroxygen bleaching compound selected from the group consisting of hydrogen peroxide, urea peroxide, and alkali metal peroxides, perborates, percarbonates, and perphosphates, and mixtures thereof; and (b) from about 1% to about 90% by weight of a bleach activator compound of the formula $$\underset{\underset{O}{\|}}{RCZ} \quad \text{or} \quad \underset{\underset{O}{\|}}{Z}CR^1\underset{\underset{O}{\|}}{C}Z$$

wherein R is a hydrocarby group containing from about 5 to about 13 carbon atoms and additionally containing from 0 to about 10 ethylene oxide groups, provided that when R contains greater than about 9 carbon atoms it must contain at least 2 ethylene oxide groups, $R^1$ is a hydrocarbyl group containing from about 4 to about 24 carbon atoms and additionally containing from 0 to about 20 ethylene oxide groups, provided that when $R^1$ contains greater than about 12 carbon atoms it must contain at least 2 ethylene oxide groups, and each Z is a leaving group, having a pKa of from about 5 to about 20 and a molecular weight of less than about 175, selected from the group consisting of:

imidazoles of the formula

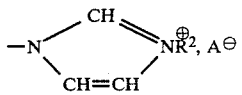

wherein $R^2$ is a $C_1$–$C_4$ alkyl group and A is an anion selected from the group consisting of hydroxide, halide, sulfate, methylsulfate and phosphate.

13. A composition according to claim 12 wherein the peroxygen bleaching compound is selected from the group consisting of sodium perborate monohydrate, sodium perborate tetrahydrate, sodium carbonate peroxyhydrate, sodium pyrophosphate peroxyhydrate, urea peroxyhydrate, sodium peroxide, and mixtures thereof and the bleach activator compound has the formula $$\underset{\underset{O}{\|}}{RCZ}.$$

* * * * *

UNITED STATES PATENT AND TRADEMARK OFFICE

CERTIFICATE OF CORRECTION

PATENT NO. : 4,367,156

DATED : January 4, 1983

INVENTOR(S) : Francis L. Diehl

It is certified that error appears in the above-identified patent and that said Letters Patent are hereby corrected as shown below:

Column 11, line 33 should read:

Sodium perborate monohydrate 38%

Signed and Sealed this

*Fifth* Day of *April 1983*

[SEAL]

*Attest:*

GERALD J. MOSSINGHOFF

*Attesting Officer*

*Commissioner of Patents and Trademarks*